US009739014B2

(12) United States Patent
Howland

(10) Patent No.: US 9,739,014 B2
(45) Date of Patent: Aug. 22, 2017

(54) ELECTROTYPE FOR FORMING AN IMAGE DURING A PAPER MAKING PROCESS

(71) Applicant: De La Rue International Limited, Hampshire (GB)

(72) Inventor: Paul Howland, Hampshire (GB)

(73) Assignee: DE LA RUE INTERNATIONAL LIMITED, Hampshire (GB)

( * ) Notice: Subject to any disclaimer, the term of this patent is extended or adjusted under 35 U.S.C. 154(b) by 251 days.

(21) Appl. No.: 14/385,804

(22) PCT Filed: Mar. 6, 2013

(86) PCT No.: PCT/GB2013/050543

§ 371 (c)(1),
(2) Date: Sep. 17, 2014

(87) PCT Pub. No.: WO2013/140126

PCT Pub. Date: Sep. 26, 2013

(65) Prior Publication Data

US 2015/0075739 A1 Mar. 19, 2015

(30) Foreign Application Priority Data

Mar. 19, 2012 (TH) ..... 1201001224

(51) Int. Cl.
*D21H 27/02* (2006.01)
*D21F 1/44* (2006.01)
(Continued)

(52) U.S. Cl.
CPC ..... *D21H 27/02* (2013.01); *C25D 1/00* (2013.01); *C25D 1/08* (2013.01); *D21F 1/44* (2013.01); *D21F 9/04* (2013.01); *D21H 21/40* (2013.01)

(58) Field of Classification Search
CPC ..... D21F 1/44; D21F 1/46; D21F 9/04; D21F 9/043; D21F 9/046; D21F 11/006;
(Continued)

(56) References Cited

U.S. PATENT DOCUMENTS 353,666 A * 12/1886 Crane ..... D21F 1/44 162/110
4,526,652 A * 7/1985 Waters ..... D21F 1/46 162/110

(Continued)

FOREIGN PATENT DOCUMENTS

CN 1734018 A 2/2006
CN 1990953 A 7/2007

(Continued)

OTHER PUBLICATIONS

Particle Size Conversion Table, Sieve Designation and Nominal Sieve Opening, Sigma-Aldrich, 2016.*

(Continued)

*Primary Examiner* — Eric Hug
(74) *Attorney, Agent, or Firm* — Ohlandt, Greeley, Ruggiero & Perle, L.L.P.

(57) ABSTRACT

The invention relates to improvements in methods of making security features, in particular electrotype security features. The electrotype for forming an image during a paper making process comprises a mesh to which is attached at least one image forming element.

25 Claims, 9 Drawing Sheets

(51) Int. Cl.

| | |
|---|---|
| ***C25D 1/08*** | (2006.01) |
| ***D21F 9/04*** | (2006.01) |
| ***C25D 1/00*** | (2006.01) |
| ***D21H 21/40*** | (2006.01) |

(58) Field of Classification Search

CPC ..... D21F 11/06; D21H 21/40; D21H 27/02; C25D 1/00; C25D 1/003; C25D 1/08; C25D 1/10

USPC ..... 162/110, 116, 361, 362, 140, 318, 319; 205/50, 69, 70, 75, 76

See application file for complete search history.

(56) References Cited

U.S. PATENT DOCUMENTS

| | | | | |
|---|---|---|---|---|
| 5,766,416 | A * | 6/1998 | Hiyoshi | D21F 1/44 162/110 |
| 5,932,071 | A * | 8/1999 | Stielow | D21F 1/46 162/308 |
| 8,524,039 | B2 * | 9/2013 | Kaule | 162/110 |
| 2001/0018113 | A1 | 8/2001 | Mallol et al. | |
| 2003/0056914 | A1 | 3/2003 | Mallol et al. | |
| 2010/0175843 | A1 | 7/2010 | Gregarek | |
| 2013/0049350 | A1 * | 2/2013 | Pallota | D21F 1/44 283/85 |

FOREIGN PATENT DOCUMENTS

| | | | |
|---|---|---|---|
| DE | 102006022059 | A1 | 12/2006 |
| DE | 102005042344 | A1 | 3/2007 |
| DE | 102009044609 | * | 4/2011 |
| EP | 0367520 | A2 | 5/1990 |
| EP | 1607235 | A1 | 12/2005 |
| EP | 2275602 | * | 1/2011 |
| FR | 2804447 | A1 | 8/2001 |
| JP | 6-81289 | * | 3/1994 |
| JP | 6-287883 | * | 10/1994 |
| WO | 0157312 | A1 | 8/2001 |
| WO | 2007028485 | A3 | 3/2007 |
| WO | 2009147393 | A1 | 12/2009 |
| WO | 2011137941 | A1 | 11/2011 |
| WO | WO 2014/065713 | * | 5/2014 |

OTHER PUBLICATIONS

Chinese Office Action dated Feb. 1, 2016 from corresponding Chinese Application No. 201380014894.3, 15 pages.

International Search Report dated May 15, 2013 for PCT application No. PCT/GB2013/050543.

Chinese Office Action dated May 27, 2015 for Chinese application No. 201380014894.3.

Great Britain Search Report dated Sep. 4, 2013 for Great Britain application No. GB1303970.6.

Chinese Office Action dated Aug. 1, 2016 from corresponding Chinese Application No. 201380014894.3, 15 pages.

Notice of Opposition dated Aug. 3, 2016 from corresponding European Application No. 13711729.7, 10 pages.

* cited by examiner

ELECTROTYPE FOR FORMING AN IMAGE DURING A PAPER MAKING PROCESS

BACKGROUND OF THE DISCLOSURE (1) Field of the Disclosure

The invention relates to improvements in methods of making security features, in particular electrotype security features.

(2) Description of the Related Art

The electrotype is not a new security feature; effectively it is a crude watermark that has been known for over 100 years. An electrotype is a thin piece of metal in the form of an image or letter that is applied to the face cloth of the cylinder mould of a papermaking machine, by sewing or more recently welding, resulting in a significant decrease in drainage and fibre deposition forming a light mark in the paper. This type of process is well known in papermaking and is described in U.S Pat. Nos. 1,901,049 and 2,009,185.

DE-A-102005042344 discloses a dewatering screen for the production of paper having multi-layered watermarks, with a support screen and a perforated watermark metal sheet connected to the support screen, in which the support screen and the watermark metal sheet are embossed jointly in the form of the watermark to be produced.

One method of producing electrotypes utilises a standard electroplating process. An image is prepared in wax, which is then sprayed with silver. Copper is then deposited on the wax to form the electrotype, which is separated from the wax base with hot water. A number of problems exist with this process:

1. The process is difficult to control and a constant thickness could not be maintained across the electrotype. This results in the final image in the paper appearing non-uniform with variable intensity;
2. Poor resolution;
3. Expensive labour intensive process.

The electrotype is typically attached to the face cloth by resistance welding. Welding tips of different diameters are available in the range 0.8 mm to 3 mm. The welding tip is placed on the electrotype with the heat transferring through the electrotype to the face cloth. The welding process becomes increasing difficult as the tip size is reduced below 2 mm, with the smaller tips resulting in distortion and an uneven surface. Practically it is not possible to weld with a tip smaller than 0.8 mm.

The papermaking process also places design constraints on the electrotype. The line width of an electrotype image is preferentially in the range 0.3-1.1 mm. Increasing the line width above 1.1 mm usually results in pinholing. This is the situation where there are insufficient fibres formed over the electrotype to form a visually continuous layer of fibres resulting in discernible holes in the paper. The minimum line spacing achievable is 0.25 mm, anything less than this is not resolvable in the final paper. If the spacing cannot be resolved the result is an increased line width that leads to pinholing.

A further limitation to the resolution of the electrotype is the size of the face cloth mesh. The typical mesh size for a face cloth is given below:

Warp (lines around cylinder)—70 wires per inch (25.4 mm), 0.2 mm diameter, 0.25 mm gap Weft (lines across cylinder)—48 wires per inch (25.4 mm), 0.2 mm diameter, 0.4 mm gap.

FIG. 1 shows three different circular electrotypes 10*a*, 10*b*, 10*c* of diameter 0.3 mm, 0.5 mm and 1 mm positioned on the wire mesh of a face cloth 5. In the case of the electrotype 10*a* formed by the 0.3 mm circle, there is negligible overlap between the warp and/or weft of the face cloth 5 and the electrotype 10*a* and it is therefore very difficult to securely weld the electrotype 10*a* to the face cloth 5. It becomes increasingly easier to obtain large enough areas of overlap as the diameter increases to 0.5 mm and 1 mm respectively as shown on the diagram by electrotypes 10*b* and 10*c* respectively.

A further problem with electrotypes is shown in FIG. 2 and relates to the generation of complex designs with unconnected elements 6. Unconnected elements 6 have to be joined with unsightly tie lines 7. The tie lines 7 are necessary because the unconnected elements 6 are too small and intricate to weld accurately in position even if the size of the unconnected elements 6 is greater than the diameter of the welding tip. The tie lines 7 effectively create one single electrotype that can be accurately positioned and welded. It is then necessary to remove the tie lines 7 before the face cloth 5 is used, this becomes very difficult and in some cases impossible when the design is very intricate. In this case the tie lines 7 are left in place and form an unwanted part of the design.

It is therefore an object of the present invention to provide an improved method of making an electrotype security feature which resolves the above described problems.

According to the invention there is provided an electrotype for attachment to the face cloth of a cylinder mould for forming an image during a paper making process, the electrotype comprising a mesh and at least one image forming element attached to the mesh.

The invention further provides a method of forming an electrotype as claimed in any one of the preceding claims comprising the steps of electroforming a first layer comprising a mesh and at least one image forming element.

BRIEF DESCRIPTION OF THE SEVERAL VIEWS OF THE DRAWINGS

A preferred embodiment of the present invention will now be described, with reference to and as shown in the accompanying drawings, in which.

DETAILED DESCRIPTION OF THE DISCLOSURE

The invention utilises a photo-electroforming (PEF) process which enables the fabrication of simple and complex components using electroplating, predominantly in two dimensions. Shapes are grown atom by atom, and fine process controls achieve very accurate tolerances with excellent repeatability.

Figure 1:
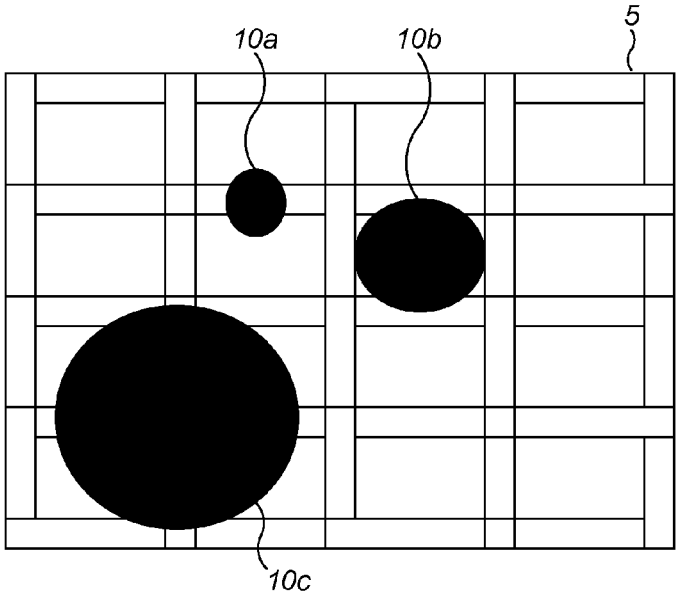
FIG. 1 is a plan view of a section of the face cloth of a cylinder mould with electrotypes attached thereto.
Figure 2:
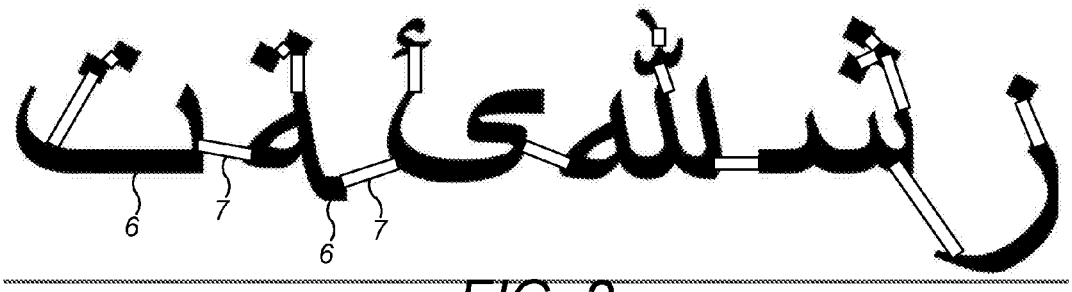
FIG. 2 is an example of a complex design for an electrotype having unconnected elements and tie lines.
Figure 3:
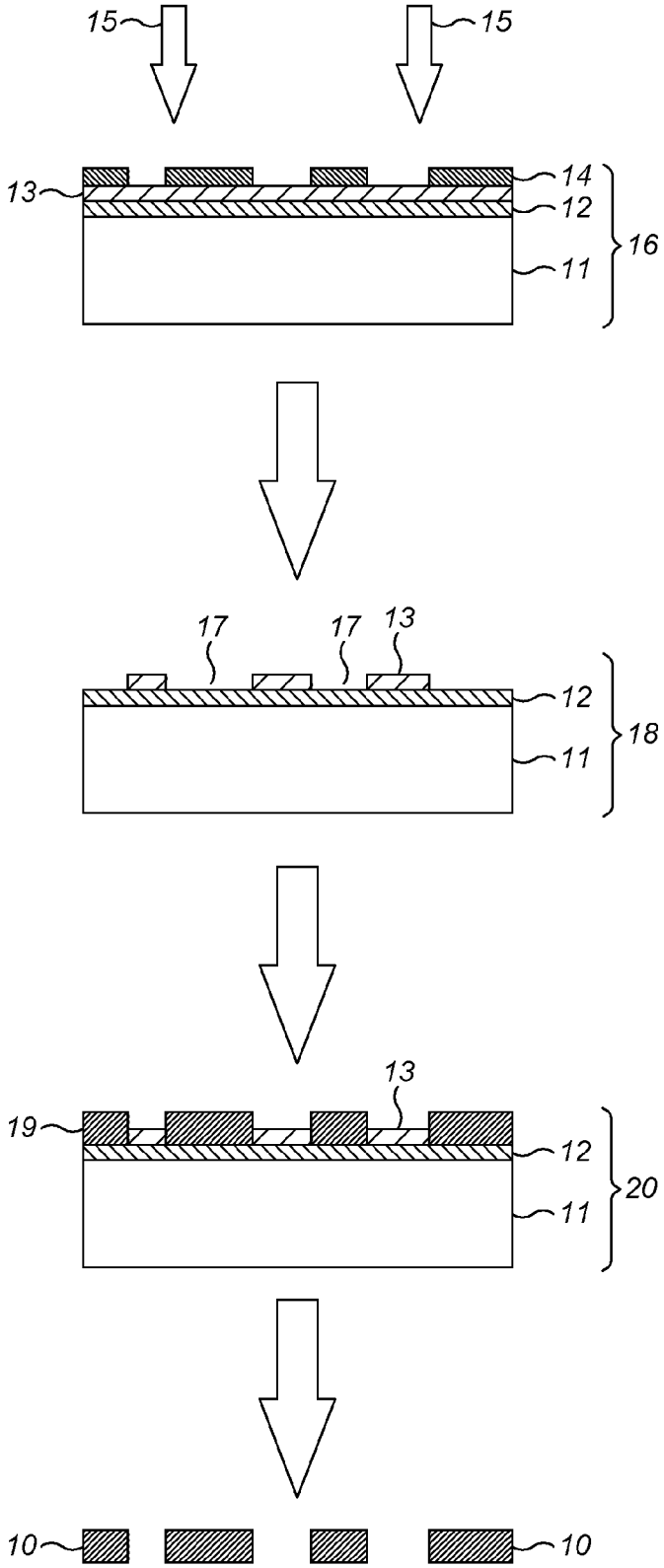
FIG. 3 is a schematic representation of a method of forming a single layer electrotype.

The original artwork for the electrotype 10 is created by using a suitable computer graphics package. The artwork is then converted into a vector image, which includes necessary distortions to take account of the electroplating process. As shown schematically in FIG. 3, a support layer 11 of photopolymer film, preferably having a thickness of 75 μm, is spray coated with a conducting layer 12, such as silver or another electrically conducting material. A layer of light sensitive photo-resist 13 (hereinafter referred to as resist) is subsequently applied to the conducting layer.

A mask 14, in the form of the required image, is placed in contact with the layer of resist 13 and the thus formed first intermediate product 16 is exposed to ultra violet light 15. As a result the resist 13 on the unexposed areas covered by the mask 14 can then be washed away. An image 17 is thus formed by the conducting layer 12 surrounded by the remaining regions of resist 13.

The thus formed second intermediate product 18 is immersed in an electroforming solution, preferably of Nickel (Ni) salt, copper, or another suitable material. Nickel is particularly suitable as it has a resistance such that when a current is passed through it during resistance welding of the electrotype to the cover, the phosphor bronze mould cover material melts and fuses with the electrotype. Other materials such as copper are too conductive but could be attached by soldering or stitching. Carefully controlled electrolysis migrates metal atoms to the conducting layer 12 until the desired thickness of the electroformed metal layer 19 is attained.

The thickness of the metal layer 19 is preferably in the region of 400 to 700 μm. Once the thus formed third intermediate product 20 is removed from the electroforming solution and rinsed, the electrotype 10 which has been "grown" can be separated from the rest of the product 20. The electrotype 10 is an image forming element which is attached to the face cloth 5 of the cylinder mould to form an electrotype mark during the paper making process.

Figure 4:
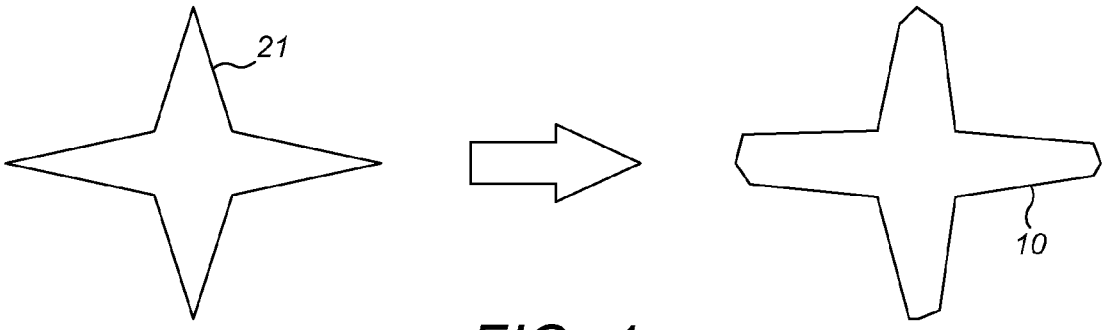
FIG. 4 illustrates the loss of resolution of an original design in the finished electrotype where the image contains small surface area regions.
Figure 5:
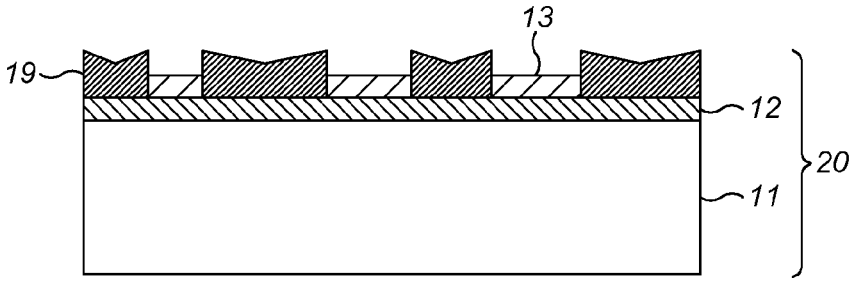
FIG. 5 is a cross sectional side elevation of the intermediate product formed by an electroplating process as a result of non-uniformed thickness.

A number of problems/issues have been found with this basic process, which requires the following modifications to optimise the process:

1. Uniformity of the metal layer 19 is very dependent on process conditions. The metallurgy of the electroforming solution is preferably optimised to ensure that the finished electrotype 10 is not too brittle. The optimisation is achieved by providing the right combination of nickel salts, concentration, other additives, current, stirring rate, geometry all designed to ensure even electro-deposition, a strong deposited material and the elimination of hydrogen bubbles that can cause pits in the deposited material
2. The electroforming solution is preferably uniformly stirred to avoid variable deposition over different regions of the electrotype 10.
3. The rate of deposition is preferably carefully controlled to avoid bubble formation that would prevent further deposition resulting in pits forming in the final electrotype 10.
4. A build up in current density may occur in regions containing a small surface area. The high current density can lead to an increase in metal deposition resulting in the formation of nodules and a subsequent loss of resolution. This is illustrated in FIG. 4, in which the original design 21 is a star having points, whereas in the electrotype 10 the points are lost.
5. It can be difficult to maintain a uniform thickness across the image area. The metal layer 19 is typically thicker at the edges and thinner in the middle of the image strip, see FIGS. 5 and 6.

Figure 7:
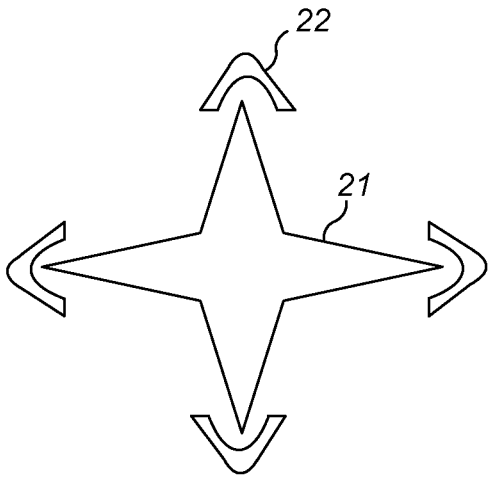
FIG. 7 is a modification of the design of FIG. 4 incorporating sacrificial areas.

The problem with poor resolution due to the build up of high current densities is resolved by the introduction of sacrificial areas 22 (known as robbers) positioned close to the high current density regions to even out the current density in these areas. An example of this is shown in FIG. 7, where the additional material is grown by the sacrificial areas 22 to disperse the high current density. The additional material is still separate from the main design 21 and can easily be removed at the end of the process leaving an electrotype 10 with good resolution in the regions of small surface area.

Figure 6:
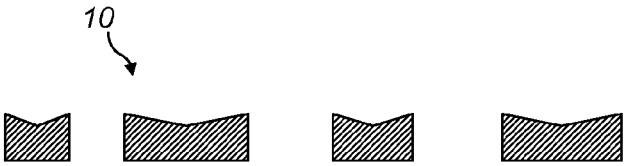
FIG. 6 is a cross sectional side elevation of an electrotype having non-uniform areas.
Figure 8:
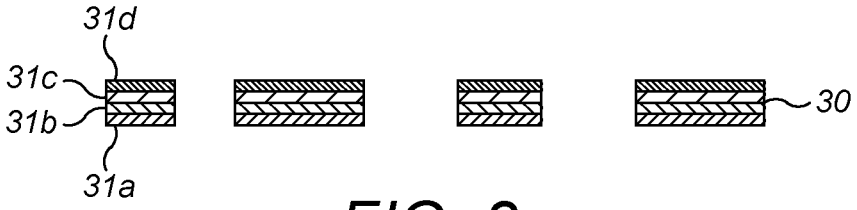
FIG. 8 is a cross sectional side elevation of a multilayer electrotype.

The difficulties in depositing a uniform thickness were attributed to the relatively high thickness of the metal layer 19 required to form the electrotype 10. The solution is to form a multilayer electrotype 30 generated by the deposition of a number of thin layers 31*a*, 31*b*, 31*c*, 31*d* (see FIG. 8). The preferred number of layers is six, although one layer may be used, especially for very simple designs. The use of more than eight layers leads to reduced cost effectiveness. The advantage of the multilayer approach is that it is significantly easier to maintain a uniform thickness distribution in a thinner layer. FIGS. 6 and 8 compare the cross-sections of an electrotype 10 formed by the single layer method and an electrotype 30 formed by the multilayer method.

In the multilayer electrotype production process the first layer 31*a* is grown as described previously, but now only to a much smaller thickness, for example around 150 μm. The third intermediate product 30 is then washed and dried and a second layer of resist 13 is applied over the whole surface. As before the required image is used as a mask 14 which is placed in contact with the second layer of resist 13 such that it is in register with the first electroformed layer 31*a*. The resulting product is then exposed to UV light and the resist 13 on the unexposed area is developed away, such that the previously electroformed image is now exposed at the surface surrounded by resist 13 in the non-image areas. The metal surface is reactivated with acid and the thus formed intermediate product is immersed in electroforming solution. A second thin layer 31*b* of metal is deposited, this time with a thickness of, preferably, around 75 μm. This process is repeated until the overall specified thickness is reached, i.e. in the order of 700 μm. The multilayer electrotype 30 is then separated from the support layer 11. This process results in a very uniform multilayer electrotype 30, which has benefits over the single layer electrotype 10.

In a further embodiment of the multilayer electrotype the number of layers can be varied across the electrotype to create a variation in the thickness of the electrotype. This would provide an electrotype which will produce a watermark with a variable brightness when viewed in transmitted light. This is because the amount of paper fibres forming over the electrotype in the paper forming process is a function of both the width and the height of the metal electrotype and therefore by varying the height across the electrotype a grey-scale watermark image can be achieved. Fewer fibres will form over thicker regions of the electrotype therefore for a constant width the thicker the electrotype the brighter the resultant watermark will be when viewed in transmitted light. In order to achieve this variation in thickness the electrotype production process would be the same as described previously but different masks would be used for one or more of the electroforming steps used to generate the electrotype image.

Figure 9:
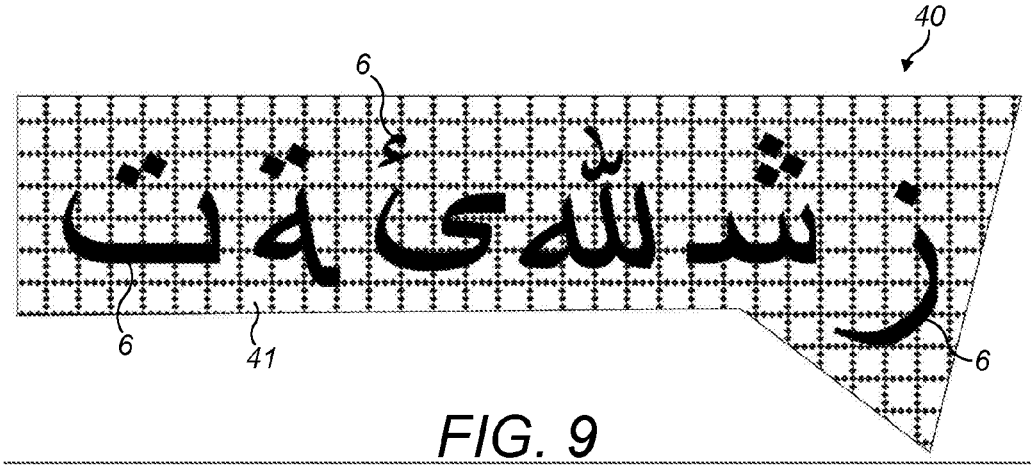
FIG. 9 is a plan view of a composite mesh electrotype.

The problems described above regarding the production of electrotypes for complex designs incorporating unconnected elements 6 can be overcome by a composite mesh electrotype 40 according to the present invention. The first layer of the composite mesh electrotype 40 is an electroformed fine mesh 41 that is used to hold together the unconnected elements 6 of the intricate design, as shown in FIG. 9. The mesh 41 is of a specific size such that its structure is substantially not visible in the finished paper to the naked eye. The size of the mesh 41 is also designed so that it does not substantially affect the drainage, thus ensuring a uniform fibre deposition. The advantage of this type of electrotype 40 is that intricate designs with a series of unconnected elements 6 can be reproduced without the need for unsightly tie lines 7. This is particularly beneficial in designs with Arabic characters, as shown in FIG. 9.

The mesh pattern is incorporated into the design 21 using the graphics software. The design 21, comprising the combination of the mesh pattern and required image, is then used as the mask 14 for the first metal layer 31*a* which is grown as described previously during the electroforming process. This first layer 31*a* is preferably grown to a thickness of approximately 75 μm. For one or more subsequent layers 31*b*, 31*c*, 31*d* the mesh pattern is removed from the mask 14, and metal is deposited only in the regions to form the required electrotype image to provide the image forming elements.

The number of layers applied after the electroformed fine mesh can be varied across the electrotype to create a variation in the thickness of the electrotype in a similar manner to that described earlier for the multilayer electrotype. This would provide an electrotype which will produce a watermark with a variable brightness when viewed in transmitted light generating a grey-scale watermark image in the final paper.

The size of the background mesh 41 is selected such that the water drainage and resultant fibre deposition is similar to that of a non-embossed face cloth 5. This ensures that, in the final paper, the pattern of the mesh does not appear as a white mark, and is similar in appearance to the background paper. It should be noted that the paper formed in the mesh region is, under close examination, discernable from the background paper because it does not have the characteristic wire mark resulting from the knuckles of the face cloth 5. Preferably the size of the mesh bars and spacing should be approximately the same size as the face cloth 5. The preferred range for the mesh line width is 50-300 microns, and more preferably 50-150 microns, and even more preferably 80-120 microns. The preferred line spacing is 100-500 microns, and more preferably 200-450 microns, and even more preferably 250-400 microns in both the horizontal and vertical directions. The preferred mesh thickness is in the range 20-150 microns, and more preferably 50-100 microns, and even more preferably 60-90 microns.

The electrotype is typically attached to the face cloth by resistance welding, soldering or stitching. In order to locate the electrotype accurately on the face cloth an embossing can be used to locate the electrotype. The embossing is shallow (for example 0.5 mm deep) and is arranged so that the electrotype is pushed up against a locating corner of the embossing. The area of the electrotype is usually arranged so that a coarser reinforcing backing layer of mesh, embossed so as to perfectly fit the forming surface is welded to the underside of the forming surface.

An electrotype mark may be coordinated with a watermark and possibly also a print design. The integration of the designs makes the features more memorable to the general public, thereby improving their ability to identify counterfeit documents, and thereby increasing the security of the documents.

Figure 10:
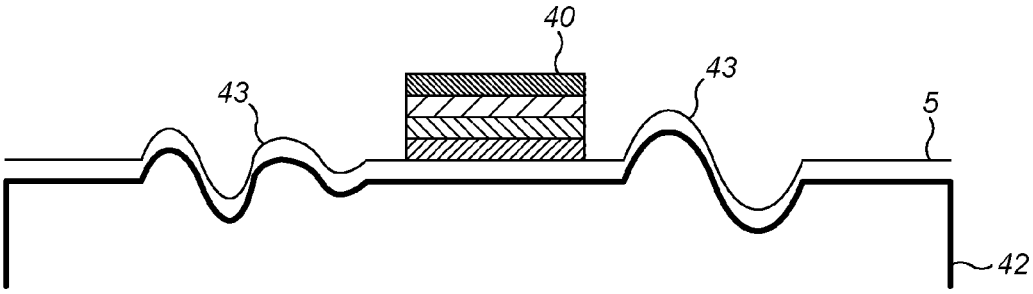
FIG. 10 is a cross sectional side elevation of a section of cylinder mould face cloth which has been embossed with a water mark image and with an electrotype attached thereto.

The electrotype mark may also form an integral part of a conventional tonal watermark, for example a watermark in the form of the head of an animal in which the bright eyes of the lion are electrotype marks. In transmission the eyes will appear significantly brighter than the conventional tonal watermark and will therefore provide a level of contrast not usually achievable. A problem with integrating the electrotype mark into the watermark lies in the difficulty in attaching the electrotype 40 to the undulating embossed region of the face cloth 5 of the cylinder mould. The specific area to which the electrotype 40 is attached must be flat, which of course is problematic within an undulating structure. However there is a second problem in that there is no support directly behind the embossing in order to prevent the mould cover becoming deformed during the welding process. In order to provide support for the welding process, the embossing die 42, which is used to form the watermark image in the face cloth 5, is also used as a support layer, see FIG. 10. It is also preferable that the top of the electrotype 40 is above the highest point of the embossed regions 43, otherwise the welder may accidentally touch and damage the face cloth 5 in the embossed area.

Figure 11:
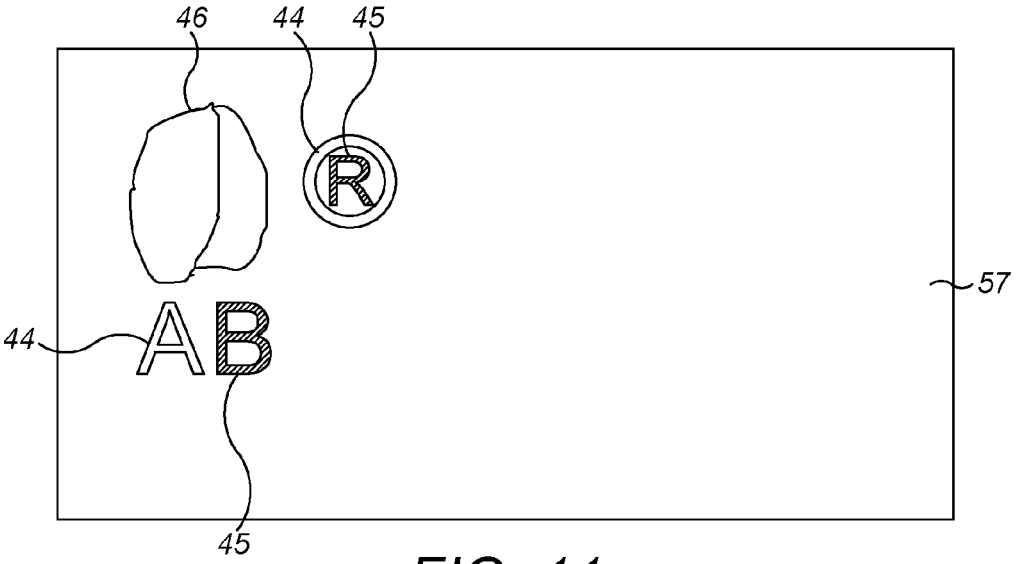
FIG. 11 is a plan view of a security paper having combined watermark and electrotype marks.

Light indicia 44 created from an electrotype 30 may be located adjacent to dark indicia 45 formed from a deep embossing 43 (which is an extreme form of watermark), as shown in FIG. 11 by the letters AB on a sheet of paper 57. The high level of contrast between the indicia 44, 45 is difficult to replicate and memorable to the general public. The contrasting light and dark regions 44, 45 may alternatively be component parts of one image as shown by the letter R in a bordering circle. Using the strongly contrasting light and dark regions 44, 45 to form one composite image increases the security further by introducing a registration requirement. FIG. 11 illustrates this increased contrast in comparison to a conventional tonal watermark 46 showing the contrast extremes achievable by this method.

Figure 12:
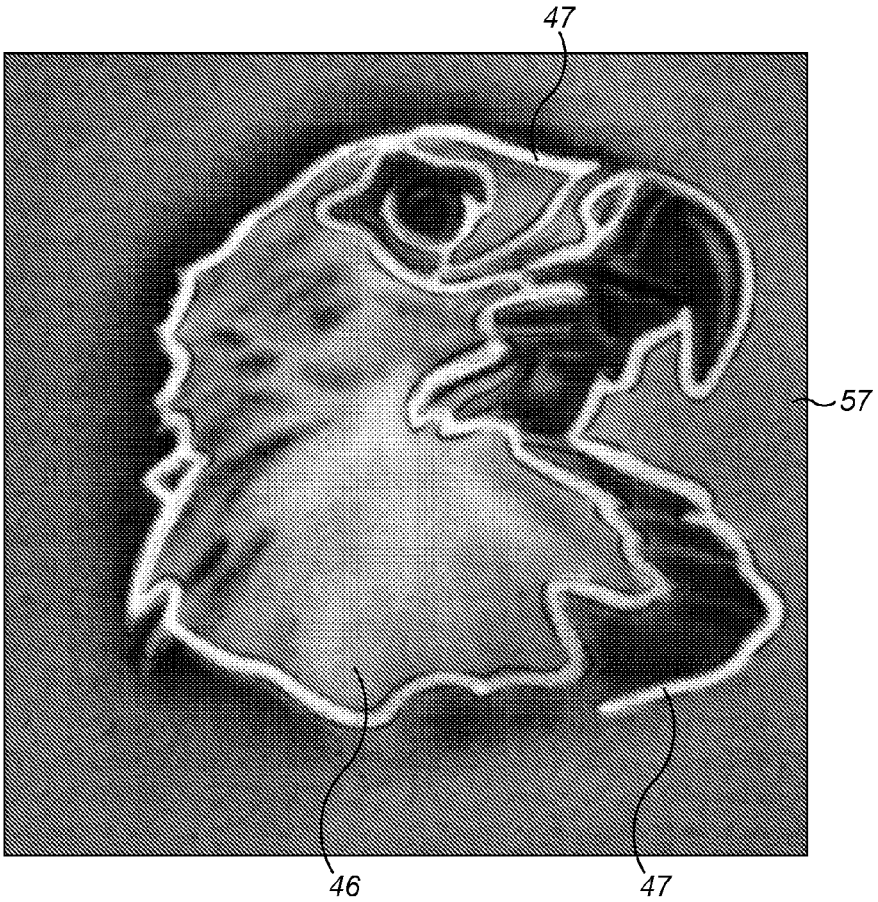
FIG. 12 is a schematic illustration of an embossed face cloth to which composite mesh electrotypes have been attached.

The electrotype 40 may also be used to form a very bright well defined area 47 around the watermark, as shown in FIG. 12.

Figure 13:
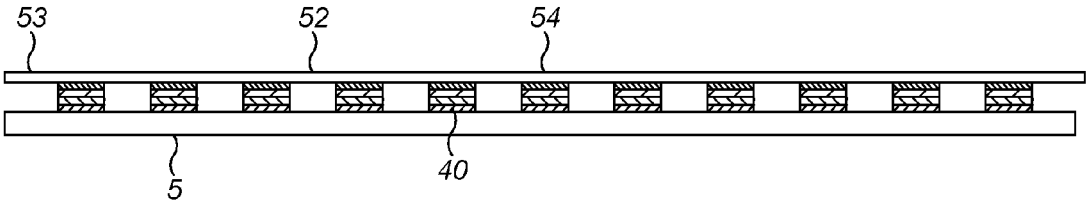
FIGS. 13 and 14 are cross sectional side elevations of sections of a face cloth to which composite mesh electrotypes have been attached, used in the process of embedding a security thread.

Composite mesh electrotypes 40 may also be used to either enhance or replace windowed thread tracks, which are formed when a windowed security thread 53 is incorporated into the paper. The raised embossed areas used to generate thread tracks may be replaced with composite mesh electrotypes 40, as shown in FIG. 13. In this example the window forming regions 54 are provided where the security thread 53 overlaps the electrotype 40 and the bridge forming regions 55 are provided where there is no electrotype 40 behind the security thread 53.

Figure 14:
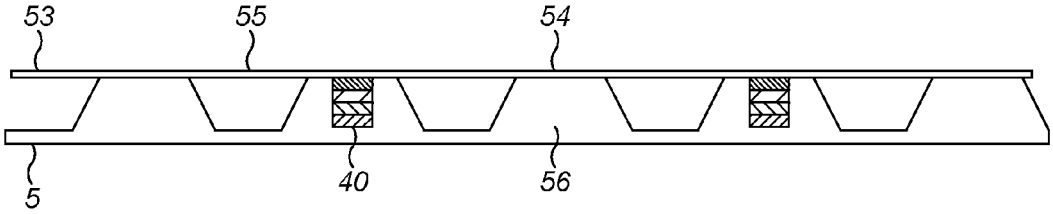

Alternatively composite mesh electrotypes 40 may be incorporated within a traditional thread track, as shown in FIG. 14. In this example the electrotype 40 must be the same height as the embossing 56. Replacing the standard thread track, or incorporating an electrotype 40 into the thread track, increases the complexity of the window design and enables a registrational and aesthetic link to be made between the thread 53 and the electrotype mark 59, thus increasing the security of the finished security feature.

Figure 15:
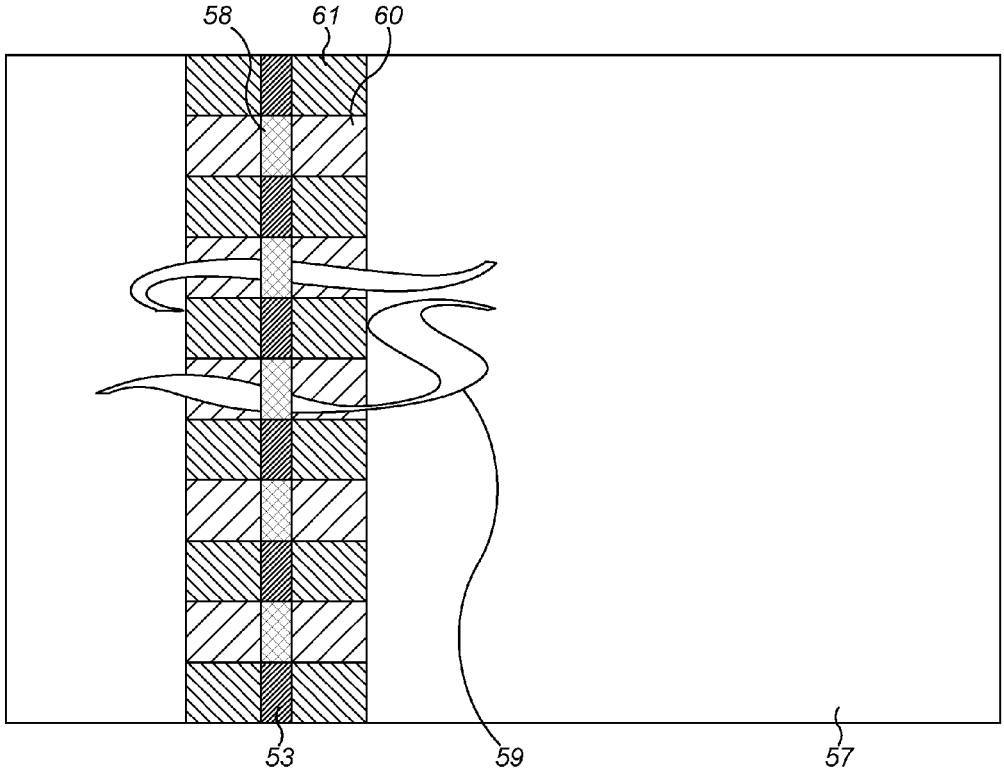
FIGS. 15 and 16 are plan views of alternate security papers having an electrotype mark combined with a window security thread.
Figure 16:
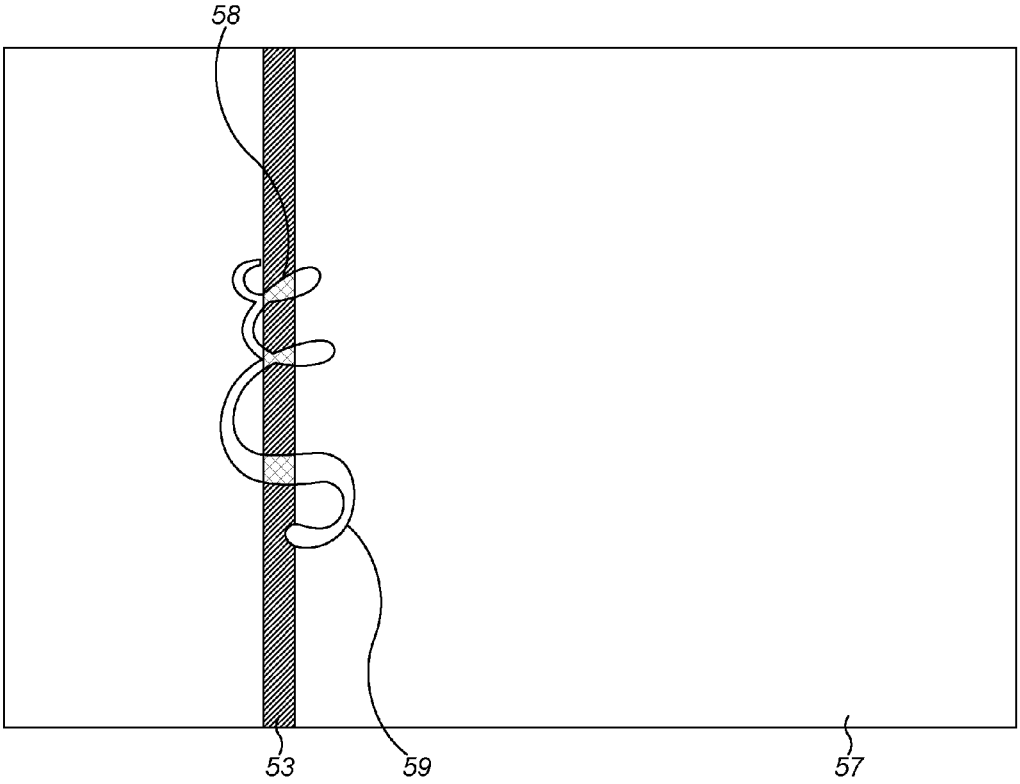

FIG. 15 shows a security paper 57 where an electrotype mark 59 is combined with a windowed security thread 53. The security thread 53 is exposed in the windows 58 and the thread tracks comprise light regions 61 of reduced grammage, compared to the base grammage of the rest of the paper, and darker regions 61 of increased grammage (bridges), compared to the base grammage of the rest of the paper. FIG. 16 shows a security paper 57 where the electrotype 40 is used on its own to expose the security thread 53.

The invention claimed is:

1. An attachment to a face cloth of a cylinder mould for forming an image during a paper making process, the attachment comprising:

an electrotype having a mesh; and at least one image forming element attached to the mesh.

2. The attachment as claimed in claim 1, wherein the at least one image forming element is a plurality of unconnected image forming elements that are attached to the mesh.

3. The attachment as claimed in claim 1, wherein the at least one image forming element comprises multiple layers.

4. The attachment as claimed in claim 1, wherein the mesh has a line width in a range of 50-300 microns.

5. The attachment as claimed in claim 4, wherein the line width is in a range 50-150 microns.

6. The attachment as claimed in claim 5, wherein the line width is in a range 80-120 microns.

7. The attachment as claimed in claim 1, wherein the mesh has a line spacing that is in a range of 100-500 microns.

8. The attachment as claimed in claim 7, wherein the line spacing is in a range of 200-450 microns.

9. The attachment as claimed in claim 8, wherein the line spacing is in a range of 250-400 microns.

10. The attachment as claimed in claim 1, wherein the mesh has a thickness that is in a range of 20-150 microns.

11. The attachment as claimed in claim 10, wherein the thickness is in a range of 50-100 microns.

12. The attachment as claimed in claim 11, wherein the thickness is in a range of 60-90 microns.

13. A method of forming an electrotype comprising:

electroforming a first layer, wherein the electrotype has a mesh and at least one image forming element attached to the mesh.

14. The method as claimed in claim 13 further comprising:

electroforming one or more additional layers on the first layer, wherein the one or more additional layers comprise the at least one image forming elements without the mesh.

15. The method as claimed in claim 13 further comprising:

forming a first intermediate product by:

a) applying a layer of a conducting material to a support layer of a photopolymer film;

b) applying a layer of light sensitive photo resist to the layer of conducting material; and c) applying a first mask comprising a mesh pattern and an image to the layer of resist;

forming a second intermediate product by:

d) exposing the first intermediate product to ultraviolet light; and e) washing away the resist on the unexposed regions covered by the mask;

forming a third intermediate product by:

f) immersing the second intermediate product in an electroforming solution and depositing metal in the regions not covered by the resist.

16. The method as claimed in claim 15 further comprising:

repeating steps a) to f) one or more times having replaced the first mask of step c) with a second mask comprising the image without the mesh pattern, to form one or more additional layers on the first layer.

17. The method as claimed in claim 13, wherein the first layer is deposited to a thickness in a range of 20-150 microns.

18. The method as claimed in claim 17, wherein the first layer is deposited to a thickness in a range of 50-100 microns.

19. The method as claimed in claim 18, wherein the first layer is deposited to a thickness in a range of 60-90 microns.

20. The method as claimed in claim 14, wherein the one or more additional layers are deposited to a thickness in a range of 20-150 microns.

21. The method as claimed in claim 20, wherein the one or more additional layers are deposited to a thickness in a range of 50-100 microns.

22. The method as claimed in claim 21, wherein the one or more additional layers is deposited to a thickness in a range of 60-90 microns.

23. A method for manufacturing security paper comprising:

forming an electrotype mark by attaching an electrotype to a cylinder mould of a paper making machine, wherein the electrotype has a mesh and at least one image forming element attached to the mesh.

24. The method as claimed in claim 23 further comprising:

forming an electrotype mark integrated with or adjacent to a conventional tonal watermark, the conventional tonal watermark being formed by embossings in a face cloth of the cylinder mould.

25. The method as claimed in claim 24, wherein the watermark is an embossed multi-tonal watermark which comprises a flat non-embossed region for incorporation of the electrotype mark.

* * * * *